US006080093A

United States Patent [19]

Henderson et al.

[11] Patent Number: 6,080,093

[45] **Date of Patent: *Jun. 27, 2000**

[54] APPARATUS FOR WICKET-TOP CONVERTING OF A CROSS-LAMINATED SYNTHETIC RESIN FIBER MESH BAG

[75] Inventors: Corbett D. Henderson, McAllen, Tex.; Jerry R. Winiecki, DePere, Wis.

[73] Assignee: Kenneth Fox Supply Company, McAllen, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/888,175

[22] Filed: Jul. 3, 1997

[51] Int. Cl.[7] ..... B31B 1/86; B31B 1/88

[52] U.S. Cl. ..... 493/187; 493/197; 493/226; 493/926

[58] Field of Search ..... 493/926, 226, 493/933, 197, 196, 287, 187, 210, 214, 222

[56] References Cited

U.S. PATENT DOCUMENTS

| | | | |
|---|---|---|---|
| 1,822,948 | 9/1931 | Armstrong . | |
| 1,906,500 | 5/1933 | Twitchell . | |
| 2,085,365 | 6/1937 | Israel . | |
| 2,128,658 | 8/1938 | Millett . | |
| 2,428,266 | 9/1947 | Daniels . | |
| 2,646,203 | 7/1953 | Brady . | |
| 2,774,402 | 12/1956 | Wikle . | |
| 2,853,225 | 9/1958 | Bauer . | |
| 2,952,397 | 9/1960 | Doyle . | |
| 3,123,279 | 3/1964 | Day . | |
| 3,257,915 | 6/1966 | Cartier et al. . | |
| 3,279,511 | 10/1966 | Griffin, Jr. . | |
| 3,554,368 | 1/1971 | Nagel . | |
| 3,721,603 | 3/1973 | Takeda . | |
| 3,733,024 | 5/1973 | Bolling, Jr. et al. . | |
| 3,967,544 | 7/1976 | Brock et al. | 493/197 |
| 4,002,519 | 1/1977 | Moseley et al. | 493/197 |
| 4,207,983 | 6/1980 | Wolske . | |
| 4,301,961 | 11/1981 | Rodish . | |
| 4,386,924 | 6/1983 | Crawford et al. | 493/926 |
| 4,403,637 | 9/1983 | Sabater et al. . | |
| 4,451,249 | 5/1984 | DeBin | 493/926 |
| 4,491,217 | 1/1985 | Weder . | |
| 4,566,927 | 1/1986 | Wood . | |
| 4,832,677 | 5/1989 | Hudgens et al. | 493/197 |
| 4,881,933 | 11/1989 | Wech | 493/197 |
| 4,883,450 | 11/1989 | Benoit | 493/926 |
| 4,889,523 | 12/1989 | Sengewald | 493/195 |
| 4,974,968 | 12/1990 | Mandus et al. | 493/195 |
| 4,988,213 | 1/1991 | Mattle | 493/226 |
| 5,294,148 | 3/1994 | Imai . | |
| 5,417,638 | 5/1995 | Anderson et al. | 493/197 |
| 5,571,361 | 11/1996 | Stuerzel | 493/197 |
| 5,741,076 | 4/1998 | Cammack . | |
| 5,823,683 | 10/1998 | Antonacci et al. | 383/107 |

FOREIGN PATENT DOCUMENTS

| | | | |
|---|---|---|---|
| 837421 | 6/1960 | United Kingdom | 493/197 |

*Primary Examiner*—Stephen F. Gerrity
*Attorney, Agent, or Firm*—Bracewell & Patterson, L.L.P.

[57] ABSTRACT

A cross-laminated synthetic resin fabric mesh material is formed into wicket-top produce bags for use with automatic bag filling equipment. A longitudinally moving sheet of the mesh is folded and formed into a folded, gusseted tubular web. Laterally spaced holes for wicket pin attachment and slots are formed at selected positions along the length of the moving web according to the desired bag height. A wicket-top attachment is then formed on the web near the wicket pin holes. The web is then cut into bag length sleeves, which are thereafter closed at an opposite end to form the bag.

11 Claims, 7 Drawing Sheets

APPARATUS FOR WICKET-TOP CONVERTING OF A CROSS-LAMINATED SYNTHETIC RESIN FIBER MESH BAG

FIELD OF THE INVENTION

The present invention relates to forming or making of wicket-top produce bags of cross-laminated synthetic resin fibers.

BACKGROUND OF THE INVENTION

So far as is known, tubular bags for holding produce for shipment and storage of produce have typically been made of polyethylene. The polyethylene bags are formed from film sheets or bands of relatively impermeable synthetic resin. The polyethylene bags have thus tended to retain moisture in with the produce contents. The retention of moisture in polyethylene bags accelerated the risk of spoilage of the produce in the bags. The polyethylene films could be perforated to allow moisture evaporation and air entry. However, the strength of the polyethylene was materially affected as the number of perforations increased. Further, due to the forming techniques used, polyethylene bags had side edge seams joining two layers of a polyethylene sheet extending upwardly from a lower transverse fold in the sheet. The retention or holding strength of the polyethylene bags was thus also limited by the strength of the side edge seams.

Recently, a woven fabric of cross-laminated synthetic resin fibers known as Cross Laminated Airy Fabric sold under the trademark CLAF® has been introduced by Amoco Fabrics & Fibers, Inc. This fabric is an open mesh material of cross-laminated warp and weft strands or fibers of synthetic resin. The CLAF® cross-laminated fiber material has adequate strength for transport and storage of produce. Also, because of the relatively large mesh or spacing of the warp and weft fibers, there was no moisture retention problem as with polyethylene films. However, the CLAF® cross-laminated fiber material was not suitable for forming into bags with techniques like those used with polyethylene films. The spaced strands at edges of the materials could not be heat sealed together with adequate holding strength for produce bag purposes.

BRIEF SUMMARY OF THE INVENTION

Briefly, the present invention forms wicket-top produce bags from cross-laminated synthetic resin fiber material mesh, such as CLAF® cross-laminated fiber material or the like. The bags are formed by advancing or passing a sheet of the synthetic resin fiber mesh from a container or storage reel through a gussetting system and a folding system to produce a tubular web configuration. After the web has been gusseted and overlap folded, it is moved longitudinally to a sealing station, where the overlapped side edge portions of the folded material are sealed together in a longitudinal direction to form a tubular bag structure.

If desired, after the sealing station, the tubular web may pass through to a print band applicator station. At such an applicator station, a printed strip or band of a suitable laminated material, which has been printed to display product advertising and bag length registration marking, is applied over sealed side edges of the tubular web.

The now-sealed tubular web structure passes to a punch and slitter station, which punches laterally spaced wicket holes across the tubular web and forms web slots adjacent the wicket holes for wicket-top converting. The wicket holes and web slots allow use of the bags in automatic bag-filling machines, providing for wicket-top waste removal and automatic filled bag removal.

The tubular web next advances to a wicket attachment station of the present invention. The wicket attachment station of the present invention includes a set of servo driven nips that creates a controlled tension in the longitudinally moving web, and an internal bag opening plate that then separates upper and lower layers of the tubular web. A cutter, such as a razor knife, thus has access to slit the upper web material layer without damage to the lower web material layer.

After the wicket top is formed in the longitudinally moving tubular web, the web is cut into bag length sleeves. The sleeves are then closed together at an opposite end from the wicket top to form bags.

BRIEF DESCRIPTION OF THE DRAWINGS

The objects, advantages and features of the invention will become more apparent by reference to the drawings which are appended thereto, wherein like numerals indicate like parts and wherein an illustrated embodiment of the invention is shown, of which.

DETAILED DESCRIPTION OF PREFERRED EMBODIMENT

Figure 1:
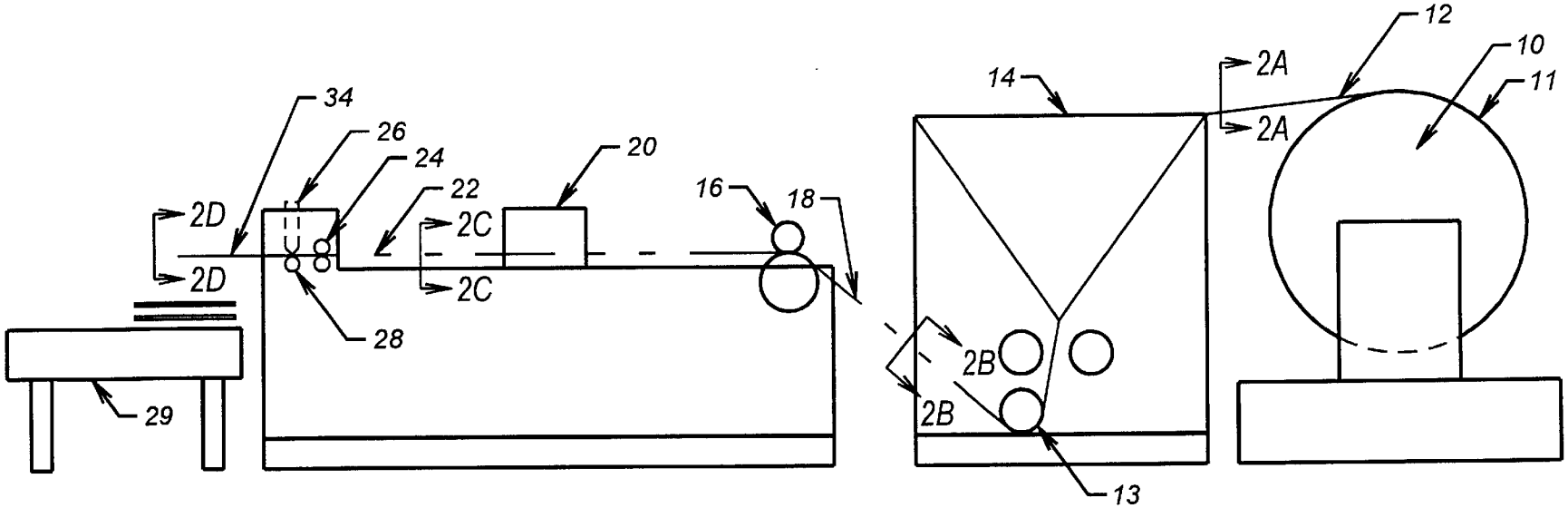
(PRIOR ART) FIG. 1
FIG. 1 is a schematic diagram of prior art techniques to manufacture a polyethylene produce bag.

To fully appreciate the nature of the present invention, an understanding of the prior art invention shown in FIGS. 1 and 2 is useful. Referring to FIG. 1, the prior art polyethylene bag converting process begins with an unwind stand 10 supporting a storage reel 11 of polyethylene lay flat material 12 of suitable width which is continuously fed from the top of the reel 11 downwardly into a web folder 14. The web folder 14 folds the incoming web 12 in about ½ of its lay flat width by advancing the web 12 downwardly around a reel 13 then advancing it upwardly. A continuous motion web drive nip 16 supplies the power needed to advance the web 12 through the web folder station 14. The web drive nip 16 also isolates the continuous feed upstream process from the downstream intermittent feed process as the web 18 leaves the web folder 14. The folded web 18 then passes under a hole punch assembly 20 which punches longitudinally spaced holes in the web 18 at a predetermined spacing so that the web can be hung on wicket pins of automatic bag filing equipment. The punched web 22 is now drawn intermittently by a servo-driven rubber nip assembly 24 toward a heated sealing member such as a V-shaped heated seal bar 26. The V-shaped heated seal bar 26 comes in contact with a lower rubber-covered seal roll 28 during the non-draw portion of the servo nip 24 cycle, providing a surface for the web 22 as the heated bar 26 cross-seals the leading 30 and trailing 32 edges of the polyethylene web 22. The seal bar 26 then severs the web 22 at these edges 30 and 32. Due to the feeding direction D of the web 22, the leading 30 and trailing 32 edges become the two side edges of the bag 34. The finished wicketed polyethylene bag 34 now drops onto a table 29 and is available for operator handling.

Figure 2A:
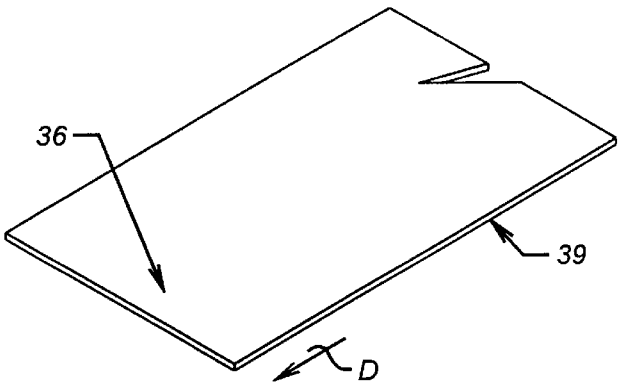
(PRIOR ART) FIG. 2A
FIGS. 2A, 2B, 2C, and 2D are isometric views of a polyethylene sheet, as it moves through the various stages of manufacture as indicated in FIG. 1 by corresponding reference numbers there.
Figure 2B:
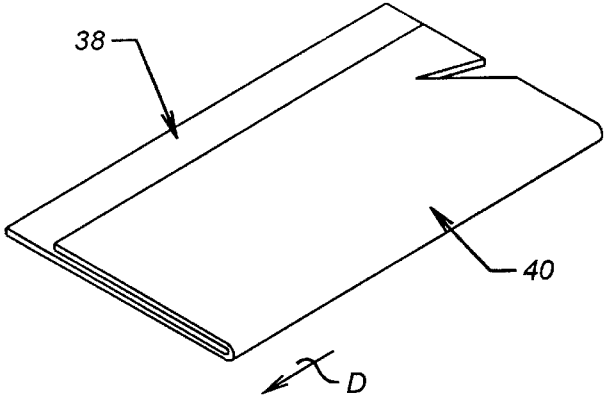
(PRIOR ART) FIG. 2B
Figure 2C:
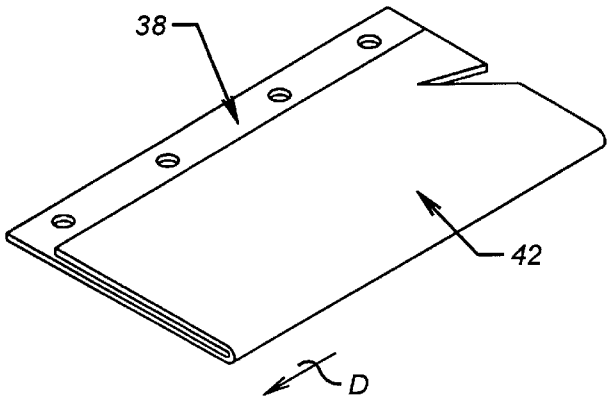
(PRIOR ART) FIG. 2C
Figure 2D:
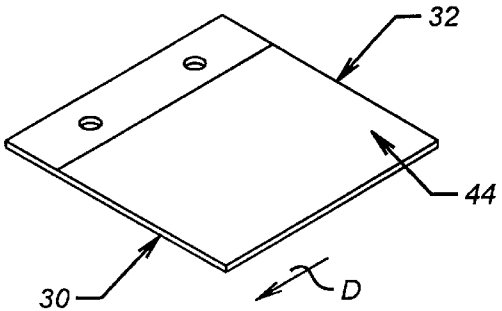
(PRIOR ART) FIG. 2D

Referring to FIGS. 2A through 2D the polyethylene web is shown at various stages of the prior art converting process described above. In the first stage, the web begins as a longitudinal moving lay flat sheeting 36 (FIG. 2A) in feed direction D. In the second stage, the web 36 passes over a web folder 14 which laterally folds the web 36 approximately into half of its width leaving an exposed lip 38 with a width of approximately 1½ inches (FIG. 2B). In the third stage, the folded web 40 passes under a hole punch assembly 20 which punches longitudinally aligned holes in the exposed lip 38 at predetermined hole spacing (FIG. 2C). In the final stage, the folded and punched web 42 comes in contact with a heated seal bar 26 to cross seal the side edges 30 and 32 of the bag, which are the leading 30 and trailing 32 edges of the web 42, and sever the finished bag sleeve 44 at these edges 30 and 32 from the upstream polyethylene web (FIG. 2D).

Figure 3:
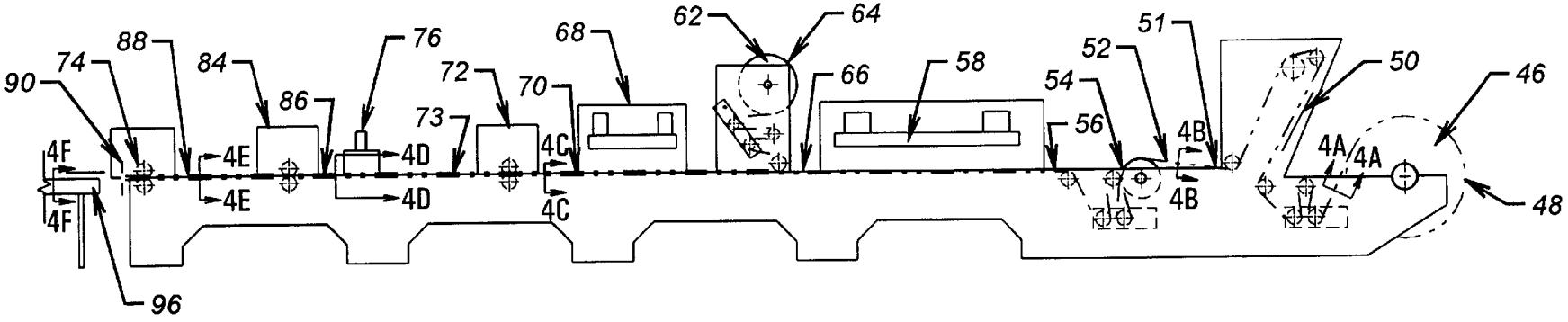
FIG. 3 is a schematic diagram of manufacture of a cross-laminated synthetic resin fiber mesh wicket-top bag according to the present invention.

Turning now to the present invention, the cross-laminated synthetic resin fiber mesh bag converting process shown in FIG. 3 begins with a unwind stand 46 supporting a storage reel of cross-laminated CLAF® cross-laminated fiber material 48 of suitable width which advances into a gussetting system 50. In the gusseting system 50, the outermost side edges 98 (FIG. 4B) of the web material 48 are folded inwardly forming gussets 99. When the finished bag 106 (FIG. 4F) is used to hold produce, the gussets 99 allow the sides of the bag 106 to expand thereby adjusting to the load of the produce. The gusseted web 51 (FIG. 3) next passes into a folding system 52. The folding system 52 folds the outermost side edges 61 (FIG. 4B) of the gusseted web 51 toward each other in an overlapping position 60 to produce a tubular web. A continuous web drive nip 54 (FIG. 3) isolates the continuous feed upstream process from the downstream intermittent feed process. The gusseted, folded tubular web 56 then comes under the influence of a heated reciprocating sealing bar 58 which seals in a longitudinal direction the overlapping outermost side edges 61 of the web 56 together (FIG. 4B).

If desired, a second unwind stand 62 (FIG. 3) supports rolls of LDPE laminated print band material 64 and applies that material 64 to the tubular web 66 (FIG. 4C) as it passes through the print band applicator station 62 to come under the influence of a second heated reciprocating sealing bar 68 (FIG. 3). The heated sealing bar 68 seals the print band material 64 along its outermost edges 65 to the tubular web material 66 (FIG. 4C). When converting straight top tubular bags 120, the web 70 is pulled intermittently by two dual servo driven nip assemblies 72 and 74 (FIG. 3) configured in a master 74 slave 72 relationship. When converting wicket-top tubular bags 116, the nip 72 is open to allow the tubular web 70 to pass through the nip 72 without constraint.

Next, the web 73 proceeds to an air operated punch and slitter attachment 76 that punches the required holes 78 (FIG. 4D) and web slots 80 and 82 to allow for wicket-top conversion. After the web 86 exits the punch and slitter attachment 76, the web 86 enters the present invention wicket attachment 84 (FIG. 3).

Figure 6:
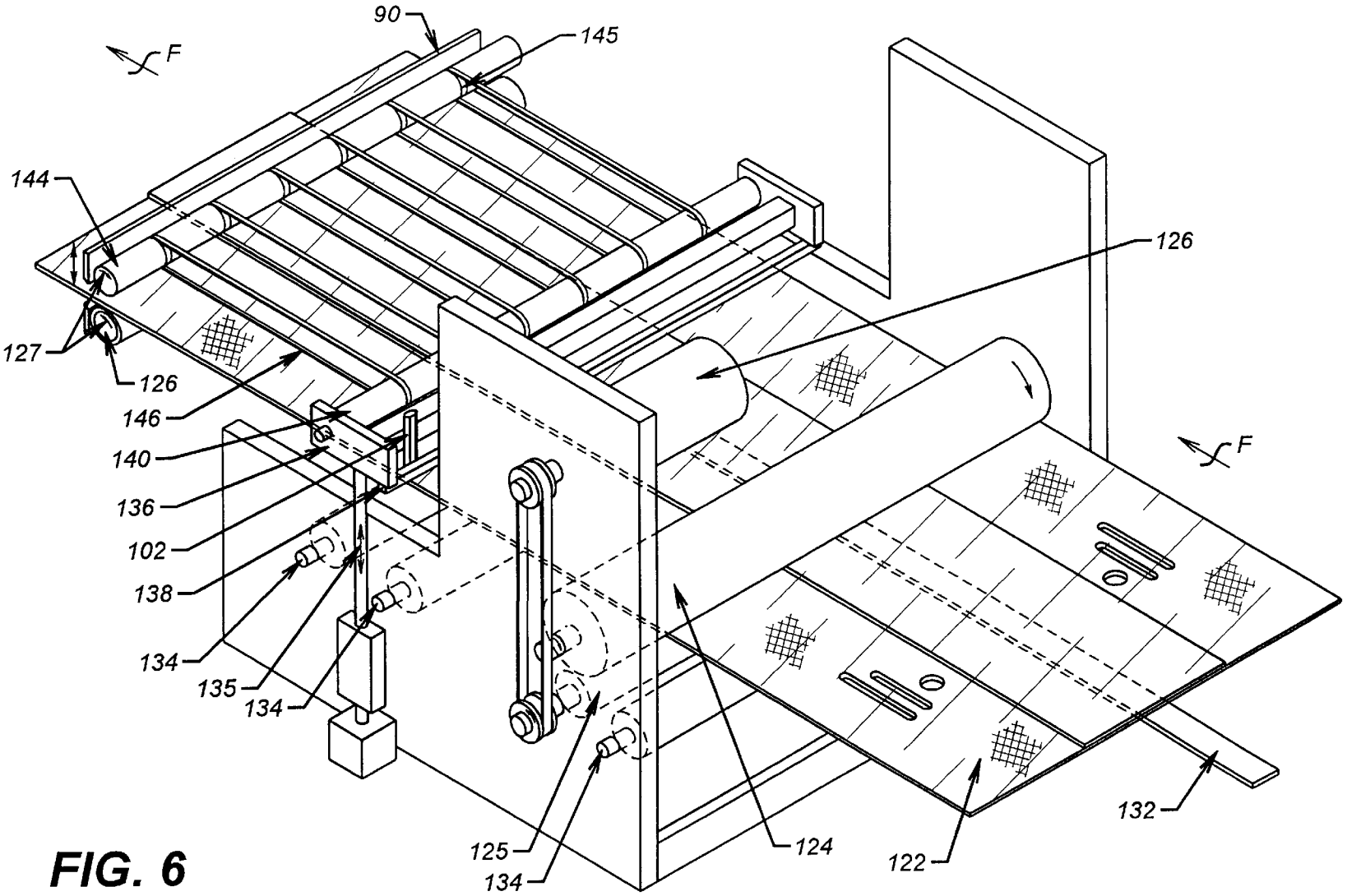
FIG. 6 is an isometric view of the wicket attachment stage of the structure shown in FIG. 3.
Figure 7:
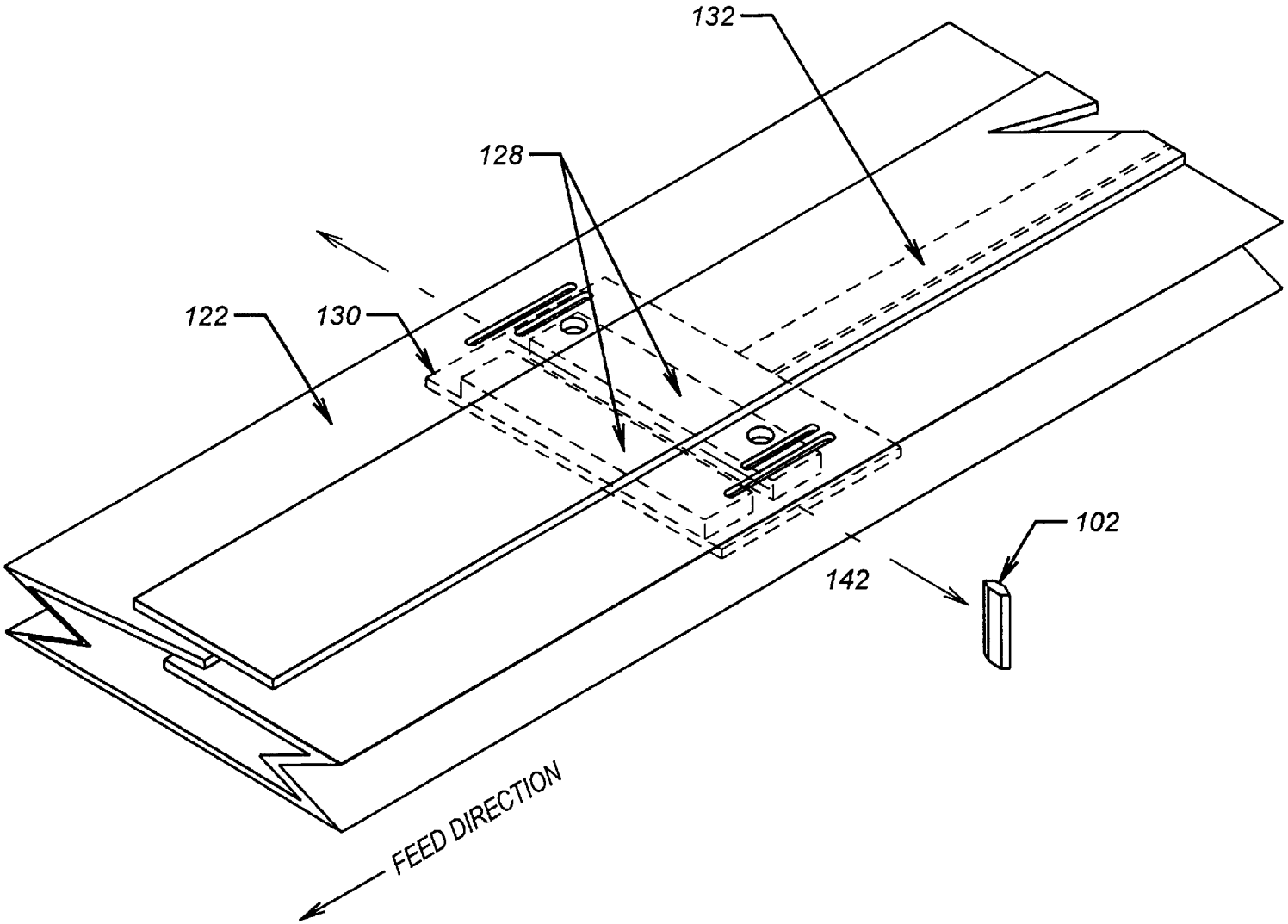
FIG. 7 is a schematic view of the cutting stage of the structure shown in FIG. 3.

Referring to FIG. 6, a resin mesh tubular web 122 is shown within the present invention wicket attachment 84 which is approximately six feet downstream of the print band sealing bar 68. The incoming resin mesh tubular web 122 is advanced intermittently by the slave servo driven nips 124 and 125 which follow the pouch machine master servo driven nip 126 in a predetermined relationship to allow for a controlled tension zone between the nip points. The tubular web 122 may be driven by either of the two servo nips 124 and 125 or by both nips 124 and 125. An internal bag opening plate 128 (FIG. 7) within the wicket attachment 84 is attached internally to a bag opening plate support base 130 by a thin metal ribbon 132 and is supported by low friction idler roller assemblies 134 (FIG. 7 and FIG. 6). The metal ribbon 132 serves to keep the bag opening plate 128 in place. When the advancing web 122 reaches the internal bag opening plate 128, the plate 128 separates the tubular web 122 to allow the razor knife 102 to slit the upper web material 112 without damage to the lower web material 111. The upper clamp assembly 136 of the wicket attachment 84 next activates in a downward motion as shown by arrow 135 during the non-draw portion of the servo nip 124 cycle. This is done to clamp the opened web 122 between the upper rubber clamp 138, the upper rubber clamp roll 140, and the lower internal bag opening plate 128. The razor-style knife 102 is then activated in the cross web direction as shown by the arrow 142 (FIG. 7) slitting the web 122. Once the web 122 has been slit, the upper clamp assembly 136 activates in an upward motion as shown by arrow 135 to unclamp the web 122 prior to servo nip 124 draw. The upper rubber clamp roll 140 is driven by the upper pouch machine servo nip roll 144 using a set of round belting 146 as the upper servo nip roll 144 and the master servo driven nip 126 rotate as shown by arrows 127. The upper clamp roll 140 and the upper servo nip roll 144 are connected with multiple strips of round belting 146 which sit in grooves 145 that are equally spaced on the rolls 140 and 144. These strips extend between the rolls 140 and 144. The set of round belting 146 aids the delivery of the slit web 122 to a pouch machine guillotine style knife 90 (FIG. 3) for web separation. The bag is then drop stacked onto a table 96 for operator handling. As the final step, the bottom edge of the bag is closed preferably by sewing.

Figure 4A:
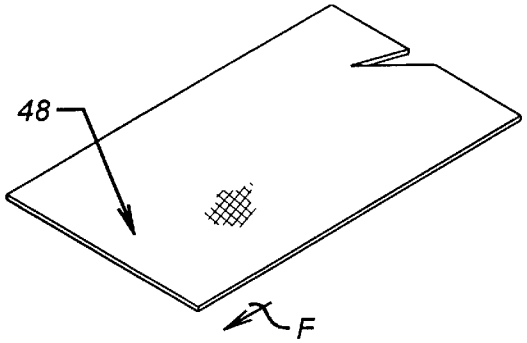
FIGS. 4A, 4B, 4C, 4D, 4E and 4F are isometric views of a cross-laminated synthetic web as it moves through the various stages of manufacture as indicated in FIG. 3 by corresponding reference numbers there.
Figure 4B:
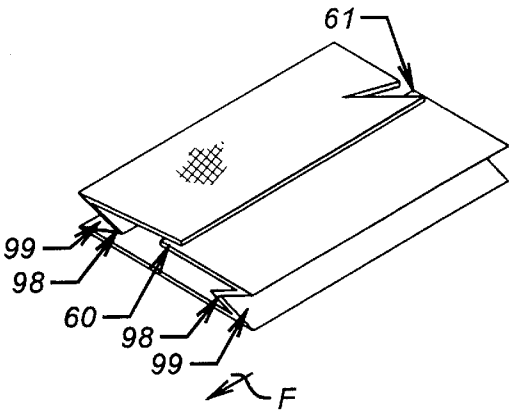
Figure 4C:
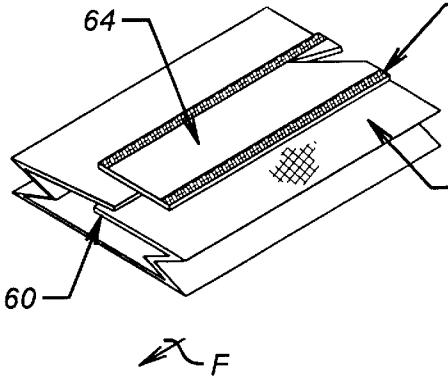
Figure 4D:
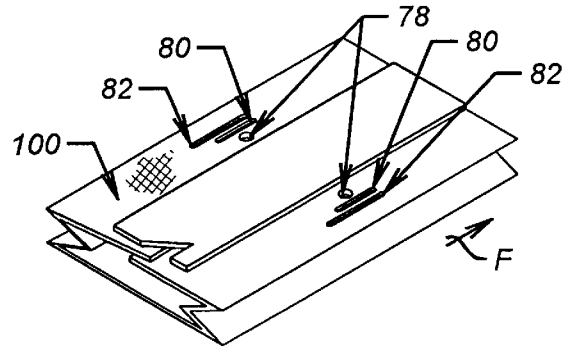
Figure 4E:
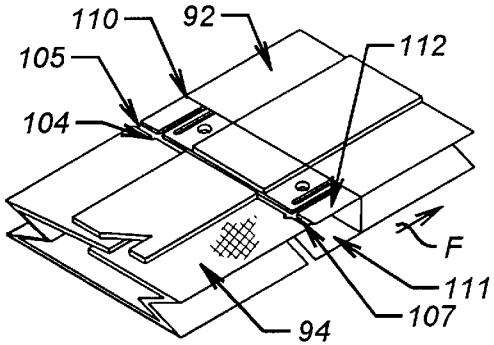
Figure 4F:
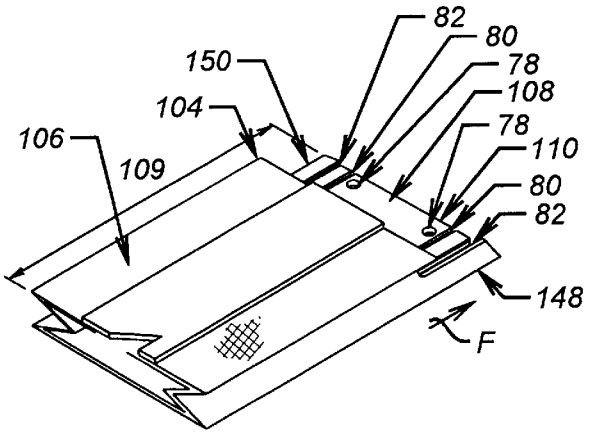
Figure 5B:
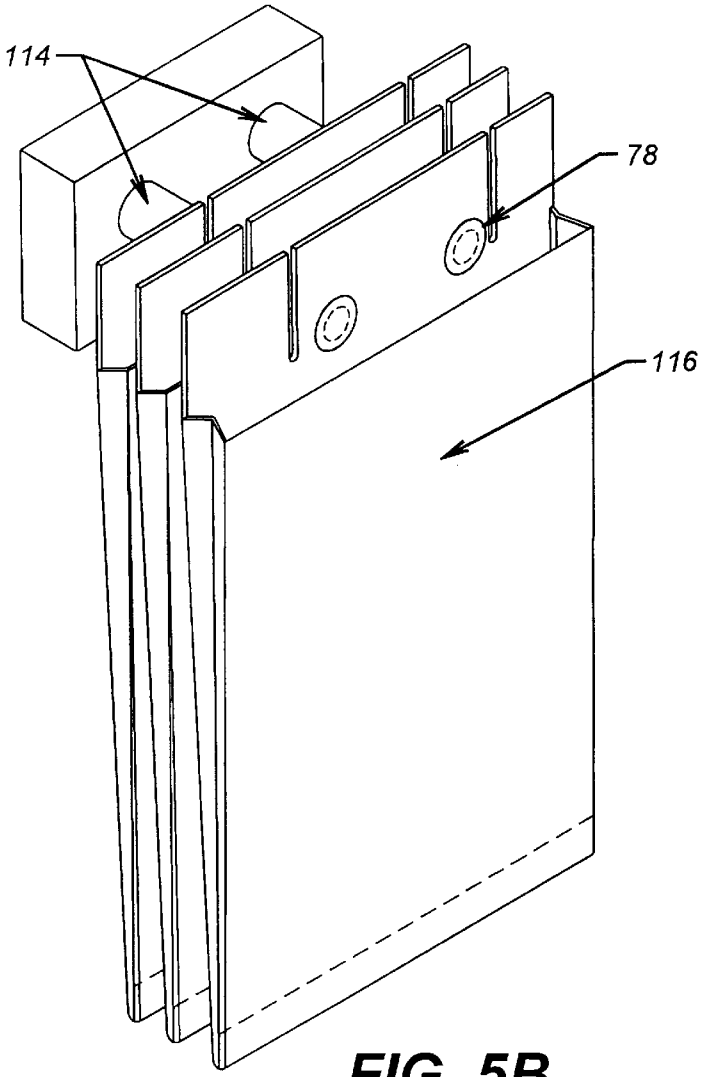
FIG. 5B is an isometric view of a finished fiber mesh wicket-top bag.
Figure 5A:
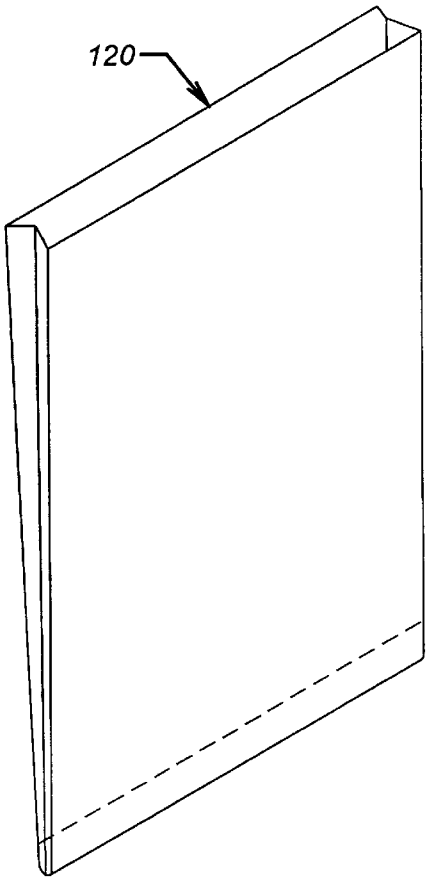
FIG. 5A is an isometric view of a finished fiber mesh straight top bag.

Referring to FIGS. 4A through 4F, the cross-laminated synthetic web is shown at various stages of the converting process previously described. In the first stage, the fiber mesh web begins as lay flat sheeting 48 longitudinally moving in the feed direction F (FIG. 4A). In the second stage, the web passes over the gussetting 50 and folding 52 stations. The gusseting station 50 produces gussets 98 that in appearance are similar to the letter "W" by folding the outermost side edges 99 of the lay flat web 48 inwardly. The folding station then folds the outermost side edges 61 of the gusseted web toward one another into an overlap position 60 (FIG. 4B). In the third stage, the overlap portion of the folded web 60 comes under the influence of the heated reciprocating seal bar 68 which seals the fiber mesh material onto itself producing a tubular structure 66. While cross-laminated fiber strands do not cross seal together with adequate holding strength, the strands do seal longitudinally onto one another. Next, if preferred, print band material 64 is applied to the tubular structure 66, and the web comes under the influence of a heated reciprocating seal bar 68 to seal the print band material 64 along its outermost edges 65 to the tubular fiber mesh web 66 (FIG. 4C).

In the fourth stage, the tubular structure 73 passes to the punch and slitter station 76 where laterally aligned holes 78 (FIG. 4D) are punched through the web 100 at predetermined spacing so that the finished bag 116 can hang on wicket pins 114 of automatic bag filing equipment. Next, the fiber mesh web 100 is slit at predetermined locations forming web slots 80 of predetermined length to allow easy tear off dispensing of a finished cross-laminated resin mesh wicket-top bag 116 from wicket pins 114 of automatic bag filling equipment. The web 100 is also slit at predetermined locations forming web slots 82 of predetermined length to allow for wicket-top waste removal (FIG. 4D). At the fifth stage, the present invention wicket attachment 84 powers a cutting member such as a razor-style knife 102 which cuts a slit 104 into and across the upper layer of tubular material spanning from one side edge 105 to the other side edge 107 (FIG. 4E).

In the final stage, the fiber mesh tubular web 106 is advanced to a predetermined finished bag length 109 where the knife assembly 90 laterally severs the tubular web 106 at a cut position 110 along the edges of the web slots 80 and 82 opposite the edge of the web slots 80 and 82 where the lateral slit 104 was made by the razor-style knife 102 to form the bag top 108. The upper layer of tubular material 112 (FIG. 4E) can now be discarded. The tubular web material 106 with the upper layer 112 removed, once bottomed is the finished wicket-top resin mesh bag 116.

It can thus be seen that the wicket attachment 84, the cross-laminated synthetic resin mesh converting process and the resin mesh wicket-top bag 116, each of the present invention, solve the problems with polyethylene wicketed bags and the incompatibility of cross-laminated synthetic resin mesh material with the converting technique for polyethylene. The porous membrane of the synthetic resin mesh wicket-top bag 116 permits air to permeate through the bag thereby preventing moisture from accumulating therein. The synthetic resin mesh tubular bag 116 is also able to adjust to the load of the produce due to its gussetting design 98 which may assume a shape similar to the letter "W". In addition, the present invention cross-laminated synthetic resin mesh wicket-top bag 106, unlike the polyethylene wicket-top bag permits easy tear-off dispensing for automatic filled bag removal by providing web slots 80 and 82, creating additional web portions that allow for tearing. While in the preferred embodiment, the web slots 80 and 82 are located between the punched holes 78 and the side edges 148 and 150, it is contemplated that aligned slots in the top portion of the web material could also be produced between the punched holes 78 and the middle of the web.

The present invention wicket attachment station 84 of the present invention opens the folded fiber mesh web 122 and slits the upper web material 112 to facilitate the removal of the upper web material 112 and formation of the present invention resin mesh wicket-top 108. Because cross-laminated synthetic fibers do not seal together in a cross direction, the lay flat sheet of resin mesh material 48 is fed into the converting machinery such that the leading 30 or trailing 32 edge of the sheet 48 becomes the top or bottom edge of the fiber mesh wicket-top bag 106. With this feeding direction F, the cross-laminated fiber strands are sealed onto each other, forming a tubular web structure 66. It is also the sealing properties of cross-laminated synthetic resin mesh material which account for the folding structure of the cross-laminated synthetic web wicket-top bag 116. While a side edge 39 of polyethylene material is folded laterally exposing a lip and forming overlapped side edges 41 for cross sealing, the tubular structure of the cross-laminated fiber mesh bag is formed by laterally folding both outermost side edges 61 of the lay flat fiber mesh sheet 48 into an overlapping position 60.

Having described the invention above, various modifications of the techniques, procedures, material and equipment will be apparent to those in the art. It is intended that all such variations within the scope and spirit of the appended claims be embraced thereby.

We claim:

1. A machine for forming open mesh wicket-top bags from a sheet of cross-laminated synthetic resin fabric, having an upper and lower surface of warp and weft fibers, with one layer of said fibers forming the outermost portion of one surface and running along the web and the other layer of said fibers forming the outermost portion of the other surface and running transverse of the web, the machine comprising:

a folding station receiving a longitudinally moving web formed from a sheet of the cross-laminate synthetic resin fabric, said folding station folding the side edges of the web toward each other in an overlapping center position above a lower central portion to produce a folded, tubular web of the fabric, with fibers in one cross-laminated surface being placed in direct contact with transverse fibers in the other cross-laminated surface;

a sealing station receiving the folded, tubular web from said folding station, said sealing station sealing together the contacting cross-laminated fibers of the overlapping side edge portions of the folded side edge layers above said lower central portion of said tubular web as it moves in a longitudinal direction therethrough;

a punch and slitter station, said punch and slitter station punching laterally spaced holes and cutting web slits in said tubular web at selected positions along its length;

a wicket forming station, said wicket forming station opening said tubular web and slitting an upper portion of said tubular web to form a wicket-top adjacent said spaced holes and web slots; and a cutting station, said cutting station cutting said web transversely across its width at selected positions for forming the wicket-top bag.

2. The machine of claim 1, further comprising:

a print band applicator station receiving said tubular web from said sealing station for applying a synthetic resin print band strip at the sealed, overlapping cental side edge portions of said tubular web.

3. The machine of claim 1, wherein the tubular web moves longitudinally through the machine and said punch and slitter station forms spaced holes laterally across the tubular web in a segment of the lower central portion of said folded tubular web at selected positions along its length.

4. The machine of claim 1, wherein the tubular web moves longitudinally through the machine and said punch and slitter station forms longitudinally extending web slits adjacent said laterally spaced holes.

5. The machine of claim 1, wherein said wicket forming station comprises:

an internal bag opening plate for opening said tubular web; and a cutting member for slitting a portion of said folded tubular web adjacent said overlapping center position.

6. The machine of claim 1, wherein said cutting station comprises a cutting member.

7. The machine of claim 1, wherein said punch and slitter station forms said tubular web into bag segments having a leading edge and a trailing edge defined by the location of said laterally spaced holes and said web slots.

8. The machine of claim 1, further including:

a gusseting station furnishing the web of fabric to said folding station, said a gusseting station receiving a longitudinally moving sheet of the fabric and forming inwardly folded gussets on each side of the web of the fabric.

9. A wicket forming mechanism for forming a wicket-top cross-laminated synthetic resin fabric bag from a longitudinally moving tubular web of synthetic resin fabric having an upper and lower surface of warp and weft fibers, with one layer of said fibers forming the outermost portion of one surface and the other layer of said fibers forming the outermost portion of the other surface, the web having side edges folded inwardly toward each other in an overlapping center portion thereof with the fibers of one surface in abutting contact with the fibers of the other surface, for forming an elongated tube have an upper surface having an overlapping center position and a lower surface, the wicket forming mechanism comprising:

an internal bag opening plate for opening said tubular web of synthetic resin fabric between said web fabric surfaces without separating the warp and weft fibers; and a cutting member for cutting the upper surface of said tubular web, adjacent said overlapping center position to form a wicket top therein.

10. The wicket attachment station of claim 9, further comprising:

a set of servo driven nips for creating a controlled tension in said web to facilitate the cutting of said web.

11. The wicket forming mechanism of claim 9, wherein the tubular web of synthetic resin fabric has inwardly folded gussets formed on each side thereof.

* * * * *